US005687796A

United States Patent [19]

Sundholm

[11] Patent Number: 5,687,796

[45] Date of Patent: Nov. 18, 1997

[54] INSTALLATION FOR FIGHTING FIRE

[76] Inventor: Göran Sundholm, Ilmari Kiannon kuja 3, FIN-04310 Tuusula, Finland

[21] Appl. No.: 325,382

[22] PCT Filed: Apr. 28, 1993

[86] PCT No.: PCT/FI93/00181

§ 371 Date: Dec. 6, 1994

§ 102(e) Date: Dec. 6, 1994

[87] PCT Pub. No.: WO93/21997

PCT Pub. Date: Nov. 11, 1993

[30] Foreign Application Priority Data

Apr. 29, 1992 [FI] Finland ..... 921937

[51] Int. Cl.[6] ..... A62C 35/58

[52] U.S. Cl. ..... 169/54; 169/16; 169/37; 169/91; 239/428.5; 454/342

[58] Field of Search ..... 169/37, 16, 5, 169/54, 91; 239/428.5; 454/342, 344, 341

[56] References Cited

U.S. PATENT DOCUMENTS

| | | | |
|---|---|---|---|
| 2,436,038 | 2/1948 | Farrell | 454/342 |
| 2,586,797 | 2/1952 | Dunlop et al. | 169/2 |
| 2,935,135 | 5/1960 | Grant | 454/342 |
| 3,884,304 | 5/1975 | Messerschmidt et al. | 169/16 |
| 4,703,808 | 11/1987 | O'Donnell | 169/91 |
| 4,765,231 | 8/1988 | Aniello | 98/33.1 |
| 4,779,801 | 10/1988 | O'Donnell | 169/91 |
| 4,986,364 | 1/1991 | Clark | 169/48 |
| 5,014,790 | 5/1991 | Papavergas | 169/44 |
| 5,253,716 | 10/1993 | Mitchell | 169/70 |
| 5,396,960 | 3/1995 | Marcott et al. | 169/54 |

FOREIGN PATENT DOCUMENTS

| | | | |
|---|---|---|---|
| 2410761 | 3/1974 | Germany | 239/428.5 |
| 1382480 | 3/1988 | U.S.S.R. | 169/54 |
| 1513326 | 10/1989 | U.S.S.R. . | |

*Primary Examiner*—Gary C. Hoge
*Attorney, Agent, or Firm*—Ladas & Parry

[57] ABSTRACT

The object of the invention is to provide a new installation for fighting fire, which is effective in restricting damages caused by smoke generation. A sprinkler (6) or a spray head is arranged in or at an air passage (7) in such a way that when the spinkler is activated it creates a suction from the fire space (1) into the air passage.

6 Claims, 13 Drawing Sheets

INSTALLATION FOR FIGHTING FIRE

The present invention relates to an installation for fighting fire, comprising at least one sprinkler, or spray head, in connection with a monitored space, In most kinds of fires the generation of smoke causes extensive damages and losses of human lives, especially in apartment fires and fires in hotel rooms and in ship cabins.

The object of the invention is to provide a new installation for fighting fire, which better than earlier known installations is capable of restricting damages caused by smoke generation.

The installation according to the invention is mainly characterized in that said at least one sprinkler or spray head is arranged to upon activation create a suction, by spraying liquid at a high drive pressure in the form of small droplets, like a fog, out of the monitored space.

Such sprinklers or spray heads are presented in the international patent application PCT/FI92/00155. By a high drive pressure is here meant a pressure range of about 20 bar to about 200 bar, as compared to about 6 bar to 10 bar for conventional sprinkler installations. The diameter of the droplets are typically within the range 50–150 microns.

Said at least one sprinkler or spray head is preferably governed by a smoke detector, in order to suck out smoke at the very beginning of a fire, even before actual fire extinguishing has been commenced.

In one preferred embodiment said at least one sprinkler is arranged in an opening from an air passage into the monitored space, and said air passage comprises at least one second opening into the monitored space, so that the sprinkler or spray head, when activated, produces a suction from the monitored space through said at least one second opening into said air passage.

When the sprinkler or spray head is activated after a fire has started, a suction is produced in said air passage, e.g an air channel, so that smoke generated by the fire is sucked into the channel via said at least one second opening and flows through the channel and out at the sprinkler or spray head, the smoke thus being intermixed with the extinguishing liquid. The smoke is thereby cooled and at least partly washed by the extinguishing liquid.

The purifying of the smoke gases can be effectivated by arranging a filter in the air channel.

Said air channel can communicate with a ventilation channel provided with a fire damper arranged to close the ventilation channel when the spray head is activated.

To utilize ordinary ventilation ducts for exhaustion of smoke may be of advantage in particular in ships and hotels. A spray head, preferably governed by a smoke detector, can be mounted in the toilet wall and directed into the toilet which usually is provided with a ventilation duct having a certain suction out.

In the following the invention shall be described with reference to exemplifying embodiments shown in the attached drawing.

Figure 16:
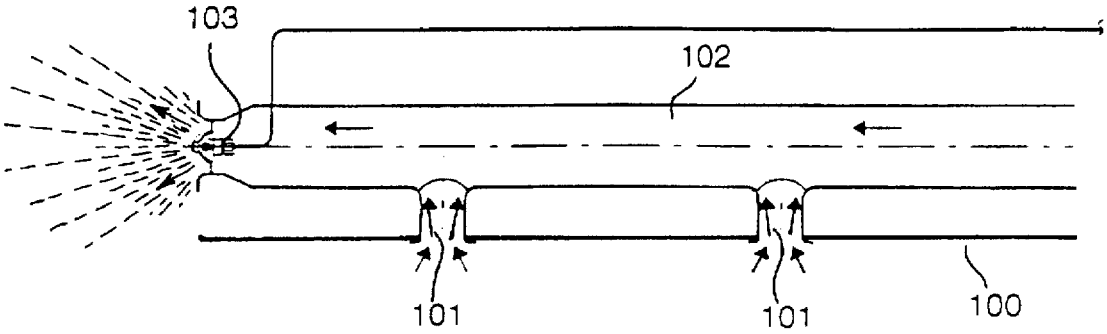
Figure 17:
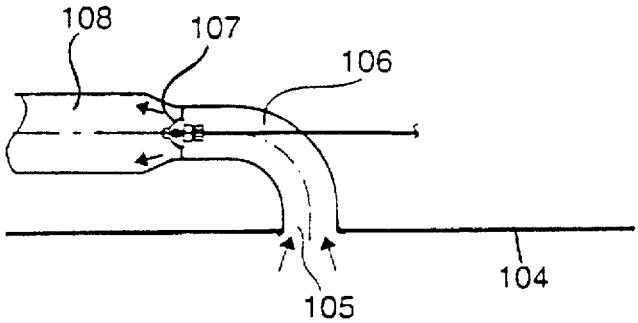

FIGS. 16 and 17 two adaptations for exhausting smoke gases.

Figure 18:
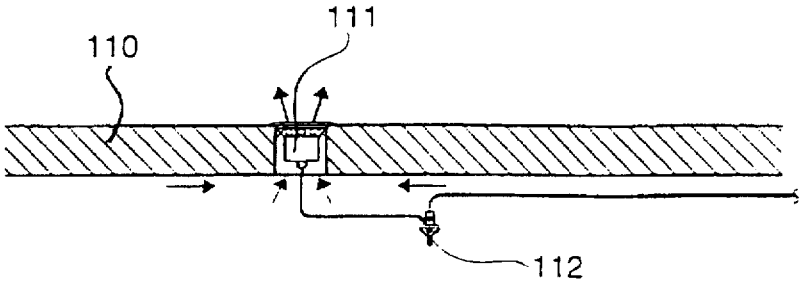
Figure 19:
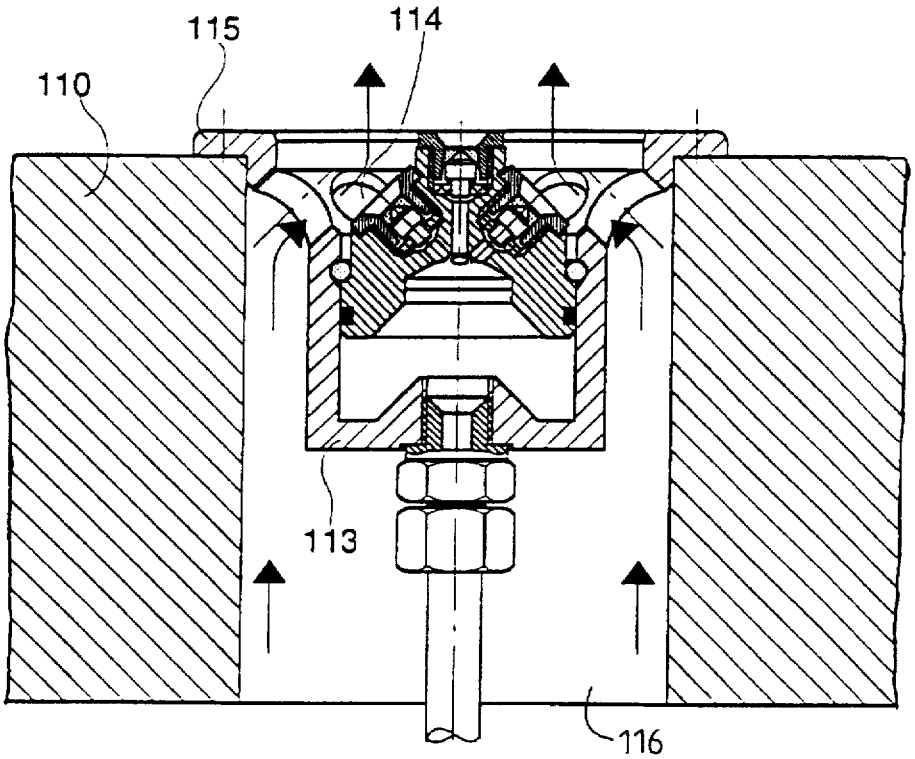

FIGS. 18 and 19 show in more detail a further embodiment of the invention.

Figure 20:
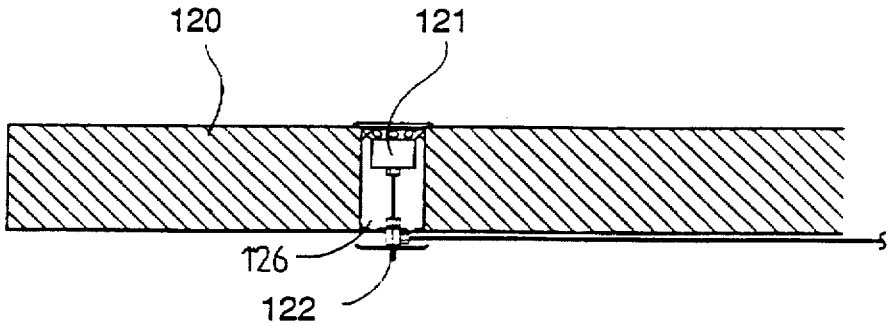
Figure 21:
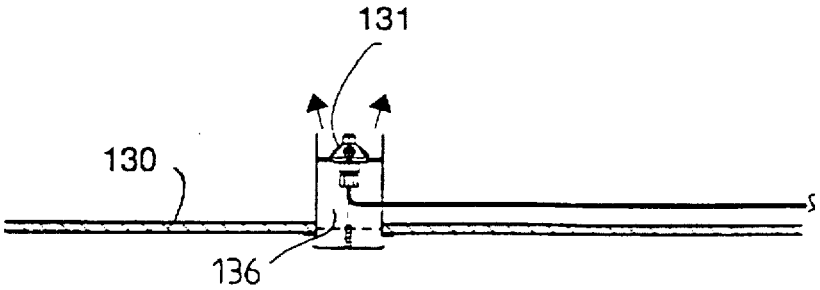

FIGS. 20 and 21 show two versions for similar purpose as in FIGS. 18 and 19.

Figure 22:
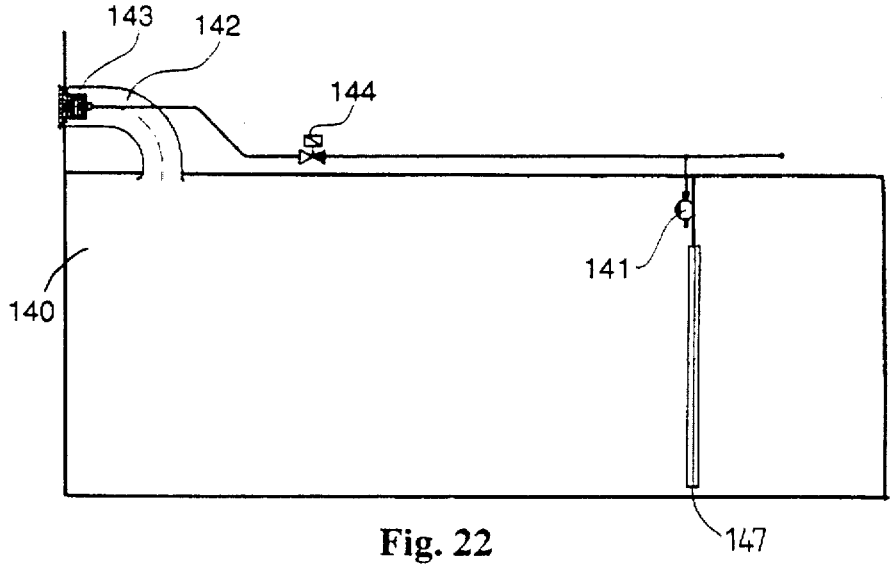
Figure 23:
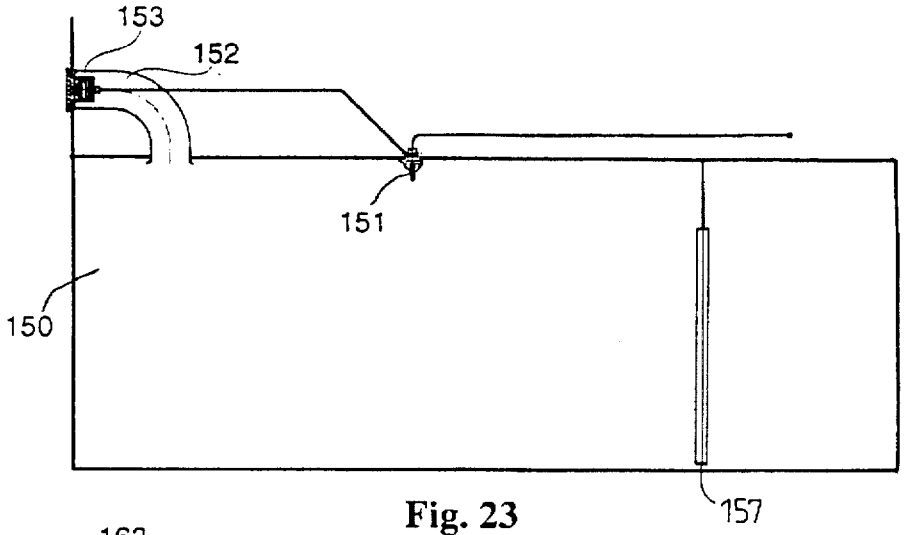
Figure 24:
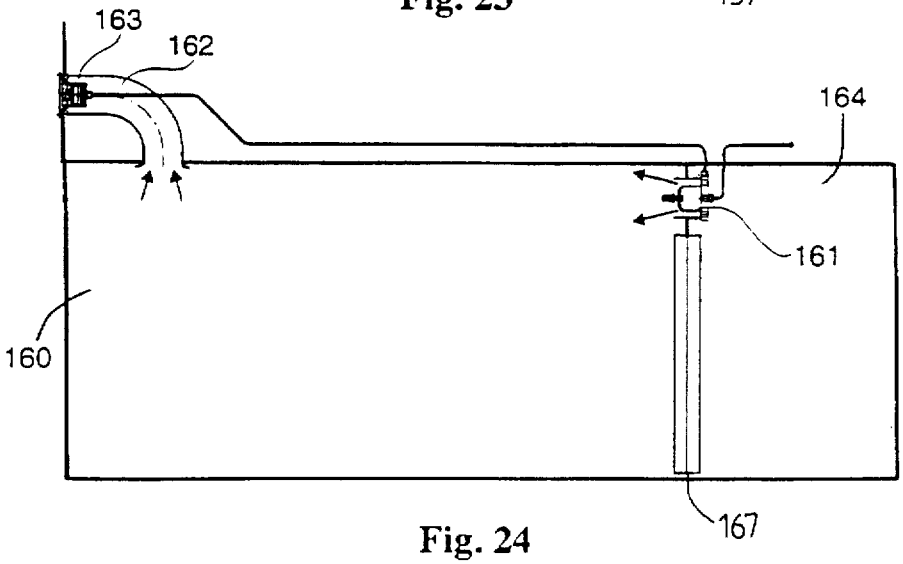

FIGS. 22, 23 and 24 show three additional alternative embodiments of the invention, in connection with a ship cabin or hotel room.

Figure 25:
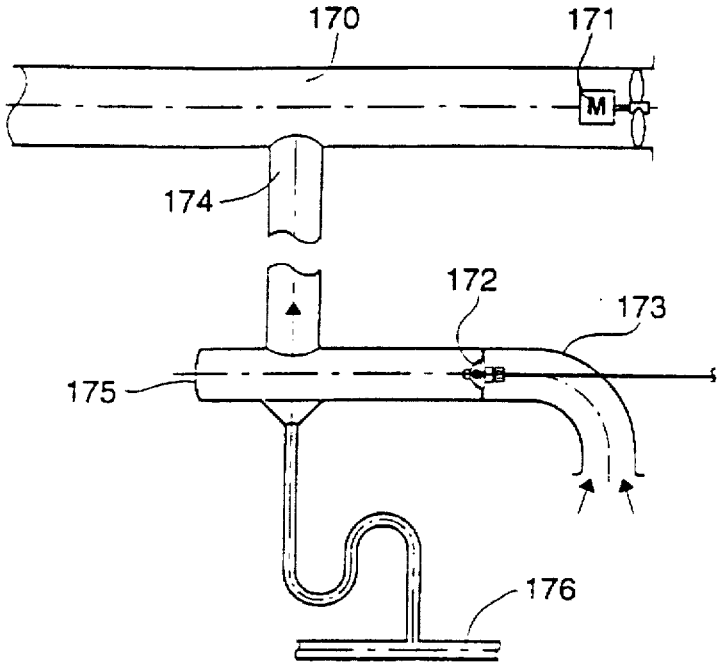
Figure 26:
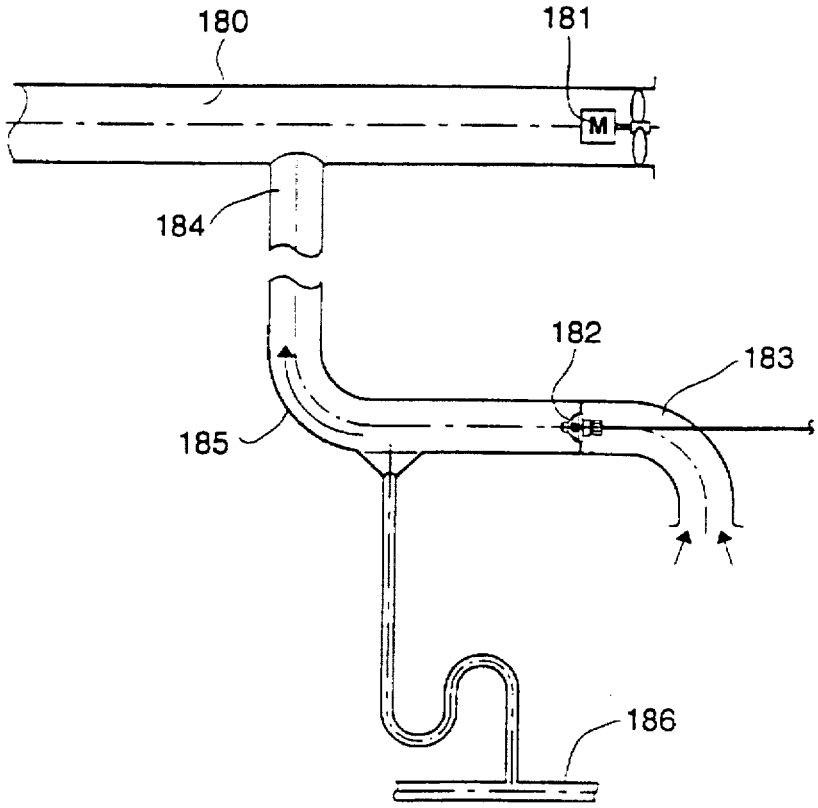

FIGS. 25 and 26 show two alternative embodiments for smoke exhaustion in combination with liquid recovery.

Figure 27:
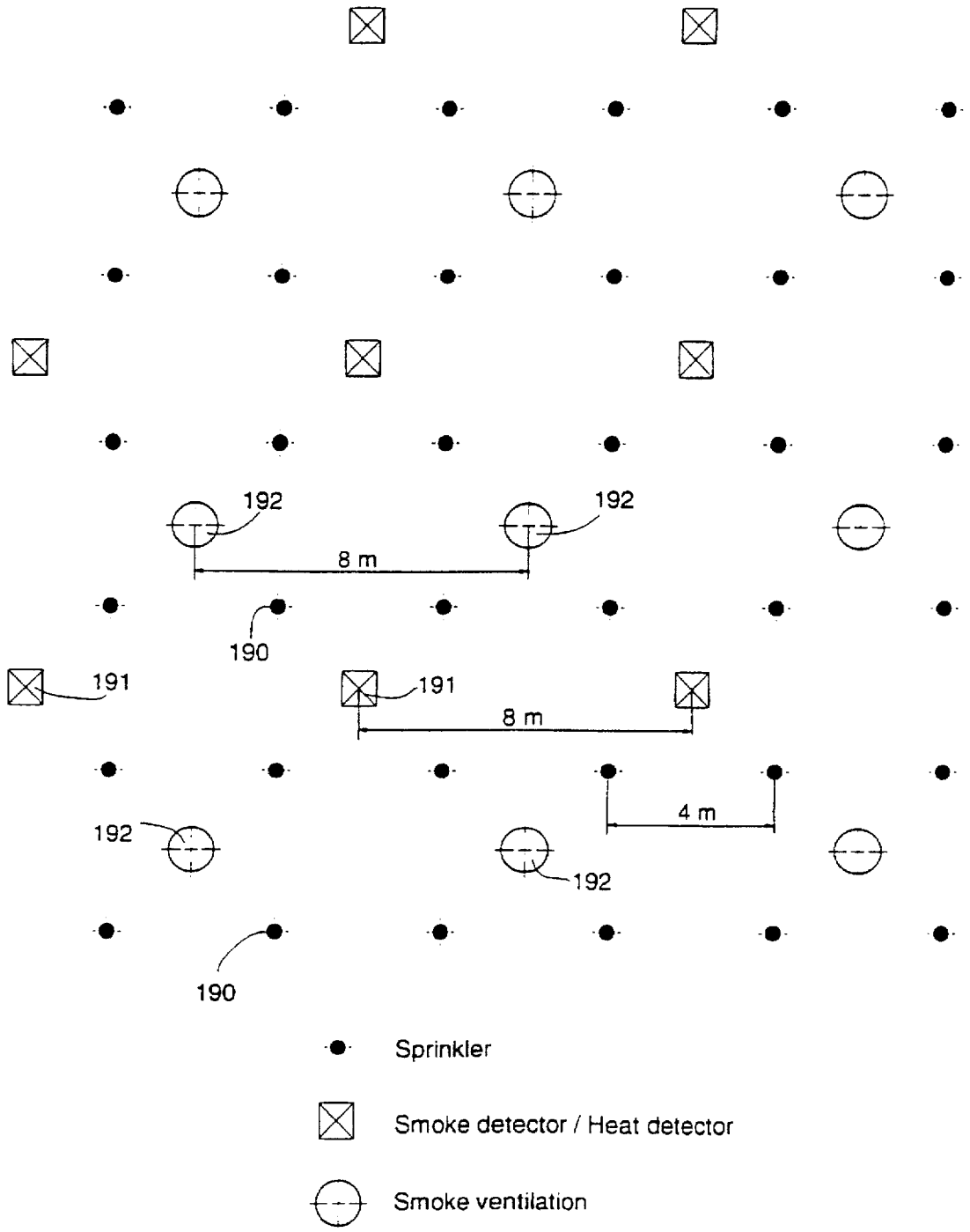

FIG. 27 shows an embodiment of the invention intended for larger spaces, such as restaurants.

Figure 1:
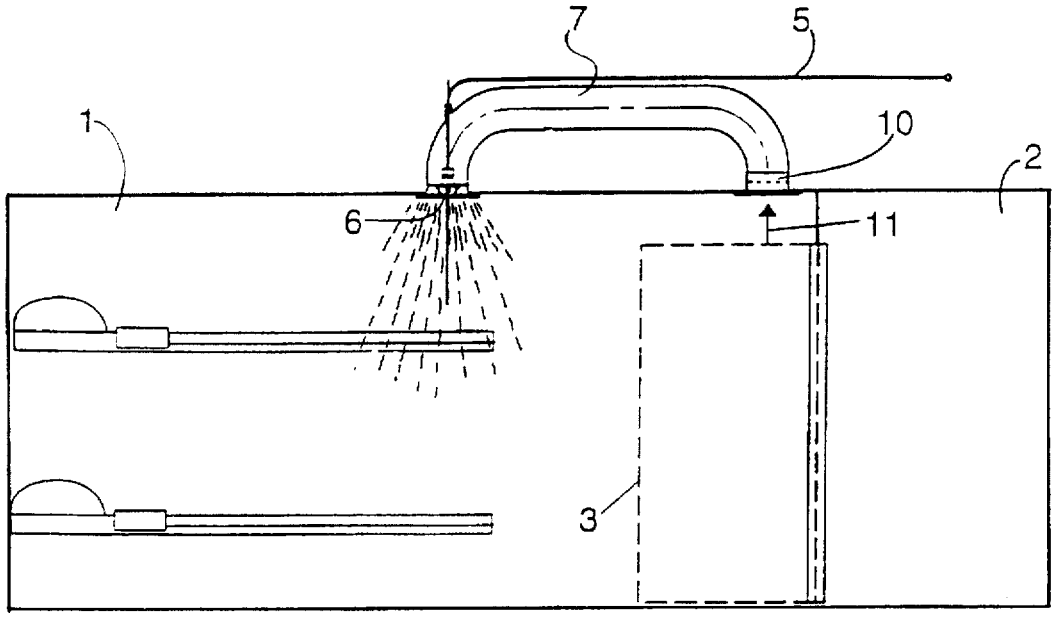
FIGS. 1 and 2 show a basic embodiment of the invention, in connection with a ship cabin.
Figure 2:
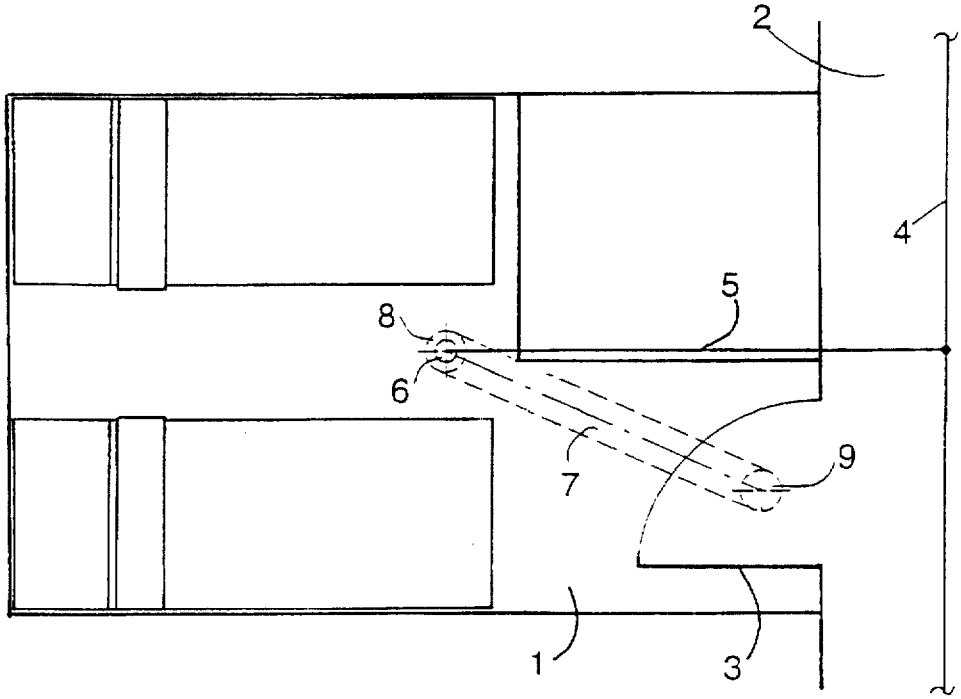

In FIGS. 1 and 2, the reference numeral 1 indicates a ship cabin with four beds, a corridor outside the cabin 1 is indicated by 2 and the cabin door to the corridor is indicated by 3. The reference numeral 4 indicates a liquid feed line and 5 indicates a branch line to a sprinkler 6 at the ceiling of the cabin 1.

The sprinkler 6 is mounted in the mouth opening 8 of an air channel 7. The air channel 7 has a second opening 9 in the ceiling of the cabin, adjacent the cabin door 3. A filter 10 is arranged in the opening 9.

FIG. 1 shows the situation when the sprinkler has been activated. The extinguishing liquid, preferably sprayed at a high drive pressure in a fog-like form, as presented e.g. in the international patent applications PCT/FI92/00060 and PCT/FI92/00155, produces a suction in the channel 7, so that smoke generated in the cabin is sucked into the channel (arrow 11) through the opening 9, is at least partly purified in the filter 10 and is cooled and washed when being intermixed in the extinguishing liquid.

Figure 3:
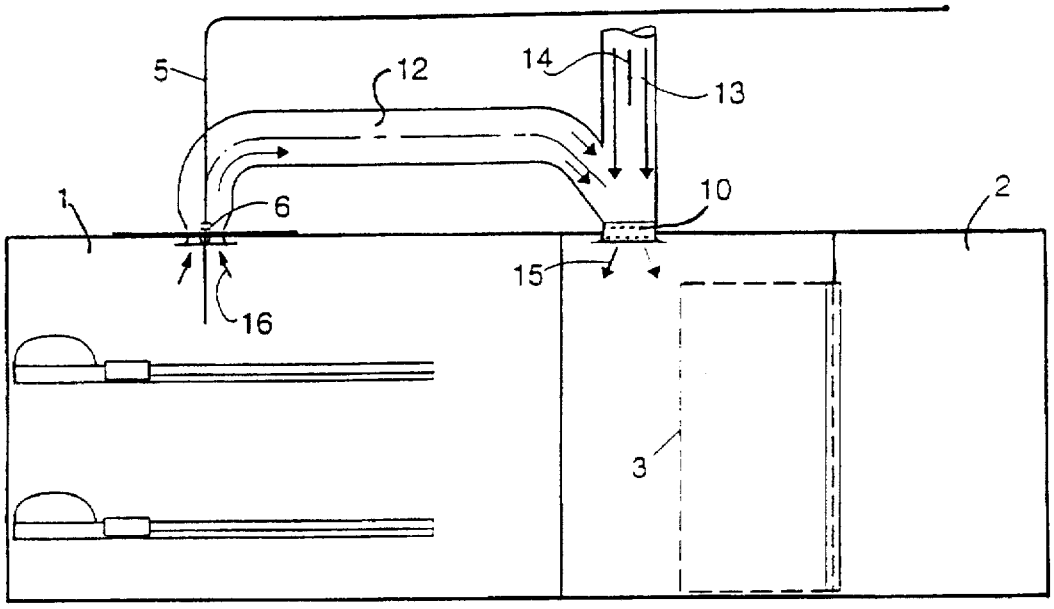
FIGS. 3 and 4 show one preferred embodiment of the invention, in combination with a ventilation channel, in connection with a ship cabin.
Figure 4:
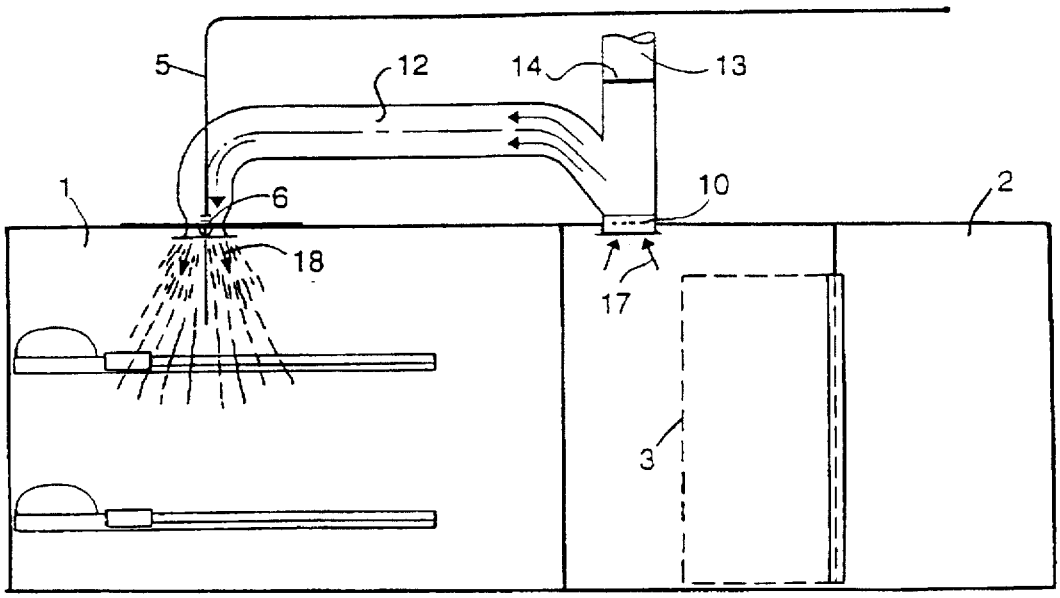

In FIGS. 3 and 4 the reference numerals 1, 2, 3, 5, 6 and 10 indicate the same as in FIGS. 1 and 2. The air channel in the mouth of which the spray head 6 is arranged, is indicated by 12 and is, near its second opening in the ceiling adjacent the cabin door 3, in communication with a ventilation duct 13 provided with a fire damper 14.

FIG. 3 shows normal state, the fire plate 14 being in open position and air flowing from the duct 13 into the cabin 1, arrows 15. The air flow in the duct 13 produces a certain suction in the channel 12, so that air flows into it, arrows 16, past the spray head 6. If a fire breaks out in the cabin, hot smoke gases will immediately flow into contact with the spray head 6 thereby effecting a fast response of the release means of the sprinkler.

In FIG. 4 the sprinkler 6 has been activated, whereat the fire plate 14 has been made to close the ventilation duct 13 and smoke gases are sucked, arrows 17, into the channel 12 through the filter 10 and are intermixed, arrows 18, into the extinguishing liquid at the sprinkler 6.

Figure 5:
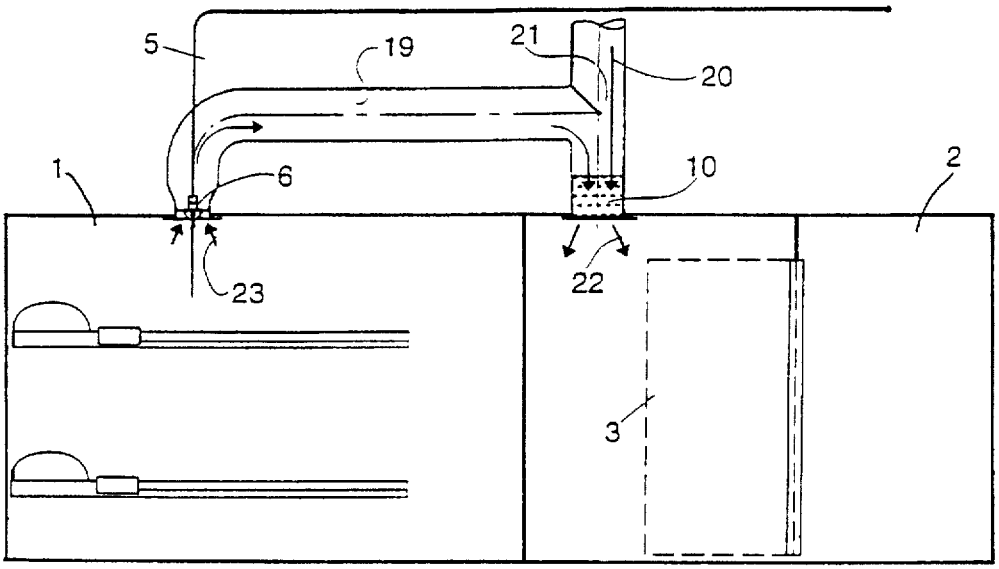
FIGS. 5 and 6 show a second alternative embodiment of the invention, in combination with a ventilation channel, in connection with a ship cabin.
Figure 6:
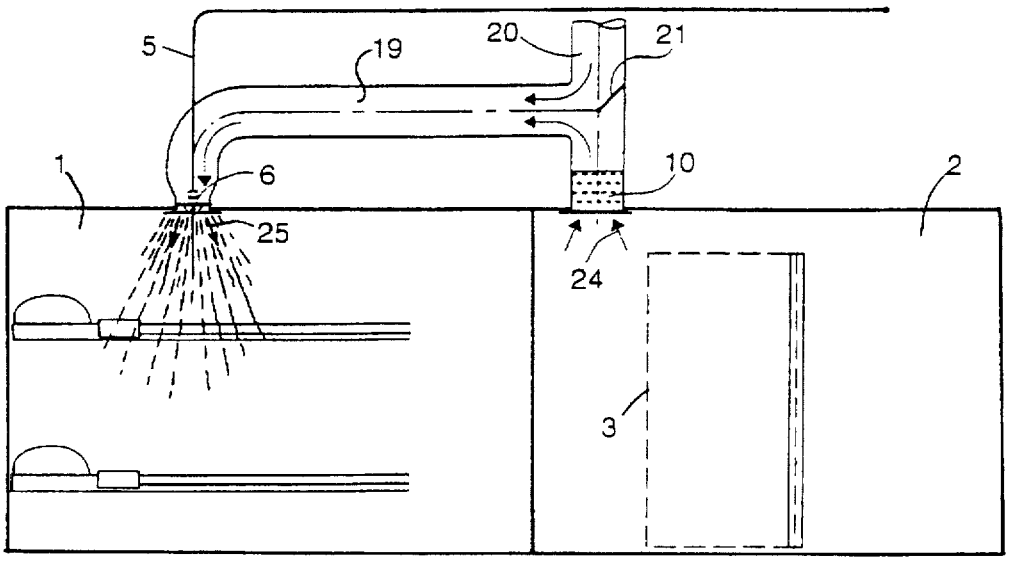

FIGS. 5 and 6 show an embodiment resembling the one of FIGS. 3 and 4. The reference numerals 1, 2, 3, 5, 6 and 10 indicate the same as earlier. An air channel 19 joins a ventilation duct 20 at some distance above the opening in the cabin ceiling adjacent the door 3. At the joint (branching) is arranged a guide plate 21 which in normal state, FIG. 5, prevents the ventilation air from entering the channel 19 and instead produces a suction therein, so that air flows into, arrows 22, the cabin at the door 3 and into, arrows 23, the channel 19 past the sprinkler 6.

In FIG. 6 the sprinkler 6 has been activated because of a fire in the cabin, and the plate 21 has been shifted to allow ventilation air to intermix with smoke gases sucked into the channel 19, arrows 24, and flowing out past the sprinkler 6, arrows 25.

Figure 7:
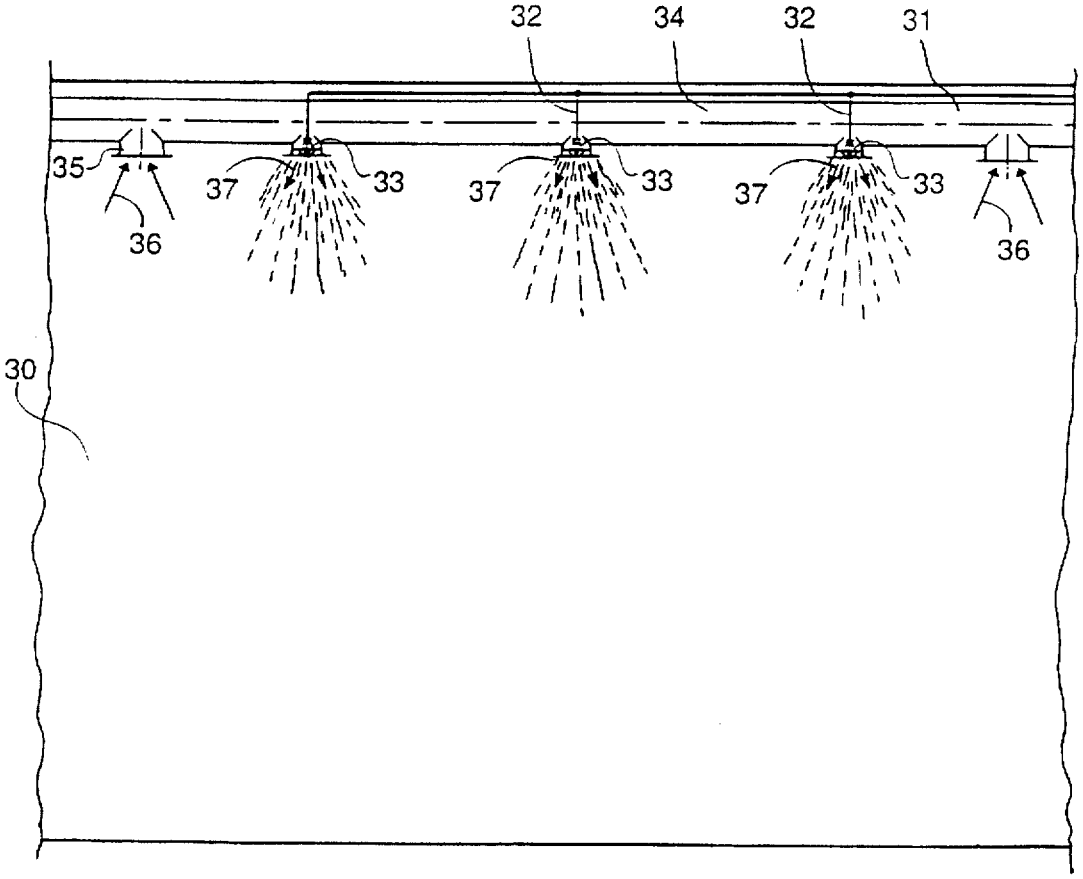
FIG. 7 shows an embodiment intended for larger spaces, e.g. a car deck in a ship.

FIG. 7 shows an embodiment as applied to a larger space, e.g. a car deck in a ship, indicated by 30. A feed line for extinguishing liquid is indicated by 31. Branches 32 from the feed line lead to a number of sprinklers 33 arranged in the wall of a ventilation duct 34, near the ceiling of the car deck 30. When the sprinklers 33 are activated, as shown in FIG. 7, they produce a suction in the duct 34, and smoke gases enter into (arrows 36) intakes 35 and flow out (arrows 37) past the sprinklers 33.

Figure 8:
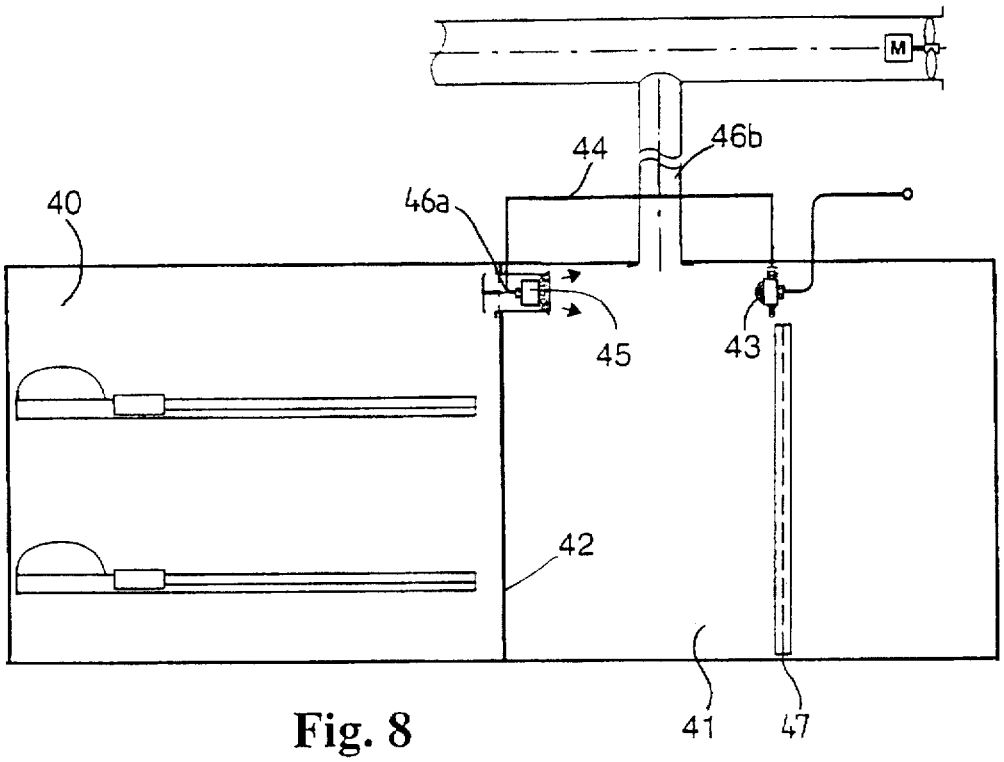
FIGS. 8 and 9 show a third preferred alternative embodiment of the invention, in connection with a ship cabin.
Figure 9:
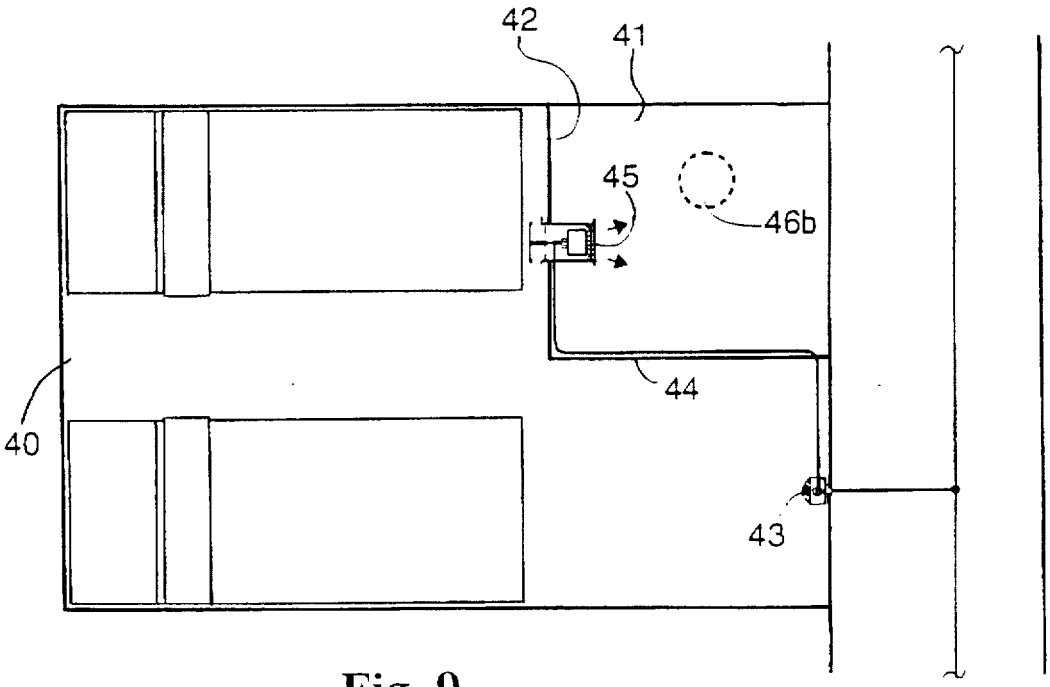

To utilize ordinary ventilation ducts for exhaustion of smoke may be of advantage in particular in ships or hotels. FIGS. 8 and 9 show a preferable embodiment. In a cabin 40 with a toilet and/or shower 41, a spray head 45 is mounted in an opening of a toilet wall 42 to be directed into the cabin toilet 41 which usually is provided with a ventilation duct, indicated by 46 and having a certain suction out. The suction may be effectivated by means of the arrangements shown later in FIGS. 17, 25 and 26, respectively. A sprinkler 43 activates through a branch line the spray head 45, e.g. in the same way as presented in the international patent application PCT/FI92/00316, with reference especially to FIG. 13 thereof.

Figure 10:
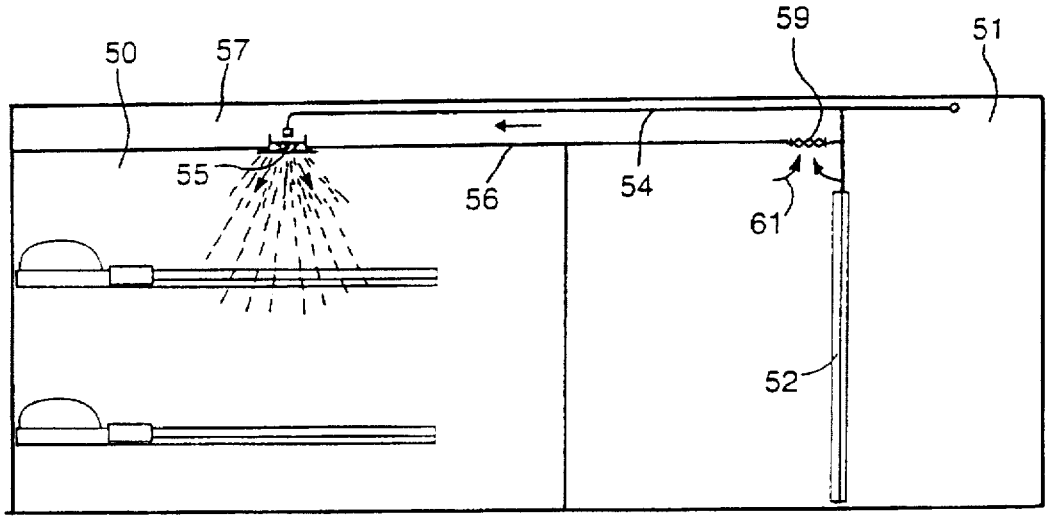
FIGS. 10 and 11 show a fourth preferred alternative embodiment of the invention, in connection with a ship cabin.
Figure 11:
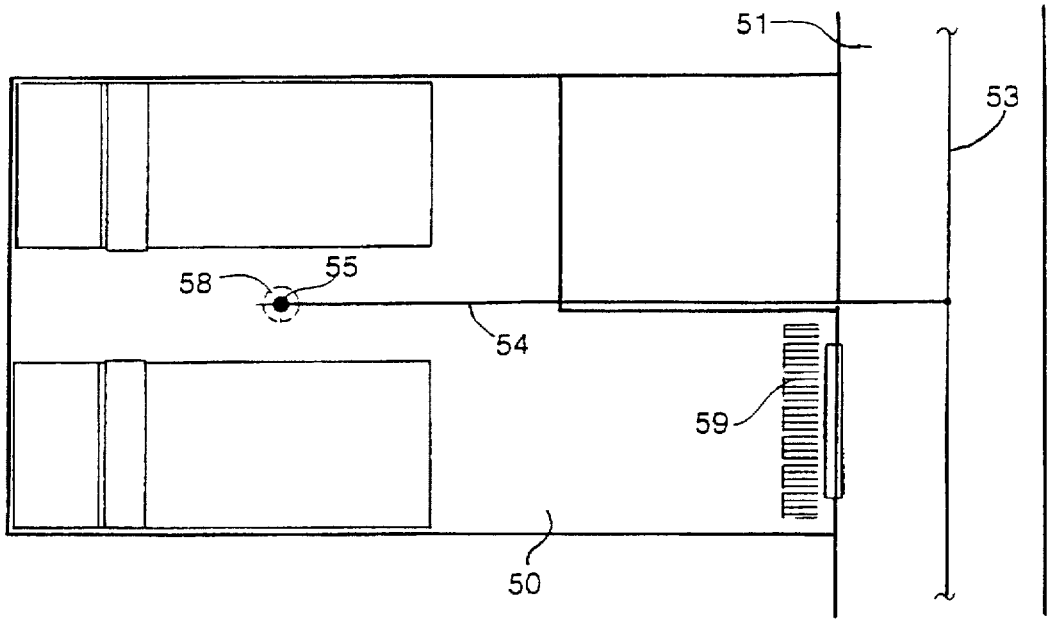

In FIGS. 10 and 11, the reference numeral 50 indicates a ship cabin, a corridor outside the cabin is indicated by 51 and the cabin door by 52. A liquid feed line is indicated by 53, and 54 indicates a branch line to a sprinkler 55.

The sprinkler 55 is mounted in an opening 48 of an inner, or lower ceiling 56 which together with the upper ceiling forms an air passage 57. The air passage 57 has a second opening 59, e.g. a ventilation opening, in the lower ceiling 56, preferably adjacent tbe door 52.

FIG. 10 shows the situation when the sprinkler 55 has been activated. The extinguishing liquid produces a suction in the passage 57, so that smoke generated in the cabin is sucked into the passage, arrows 61, and is cooled and washed when being intermixed with the extinguishing liquid at the sprinkler 65.

Figure 12:
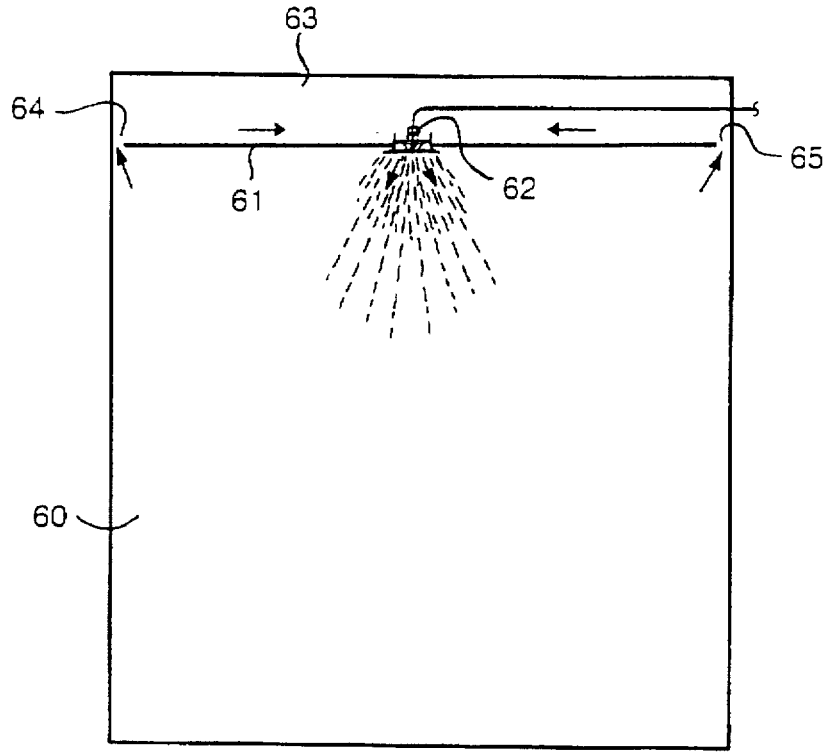
FIGS. 12 and 13 illustrate two basic embodiments of the invention, for use in a ceiling and in a floor, respectively.

In FIG. 12, a room is indicated by 60, a lower ceiling is indicated by 61 and a sprinkler mounted in an opening of the lower ceiling is indicated by 62. An air passage 63 is formed between the lower ceiling 61 and the upper ceiling, and when the sprinkler 62 has been activated, as shown in FIG. 12, fog is sucked into the passage 63 through a number of secondary openings 64 and 65 in the lower ceiling 61, e.g. near the walls of the room and can extinguish a fire, such as e.g. a cable fire, in the passage 63 as well.

Figure 13:
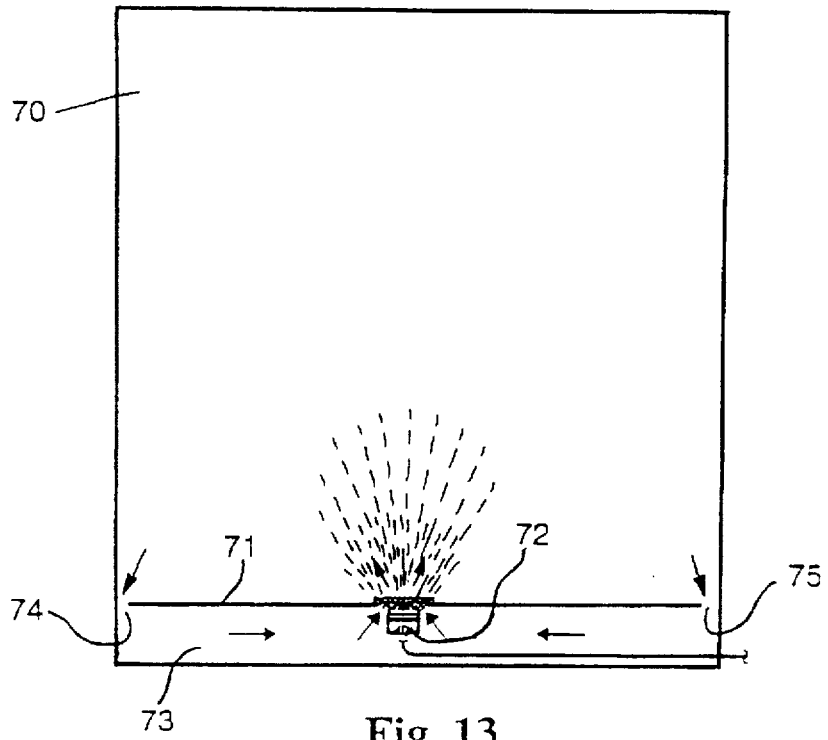

In FIG. 13, a room is indicated by 70, a floor is indicated by 71 and a sprinkler mounted in an opening of the floor is indicated by 72. Under the floor 71 is an air passage 73, and when the sprinkler 62 has been activated, as shown in FIG. 13, fog is sucked into the passage 63 through a number of secondary openings 64 and 65 in the floor 61, e.g. near the walls of the room and can extinguish a fire, such as e.g. a cable fire, in the passage 73.

Figure 14:
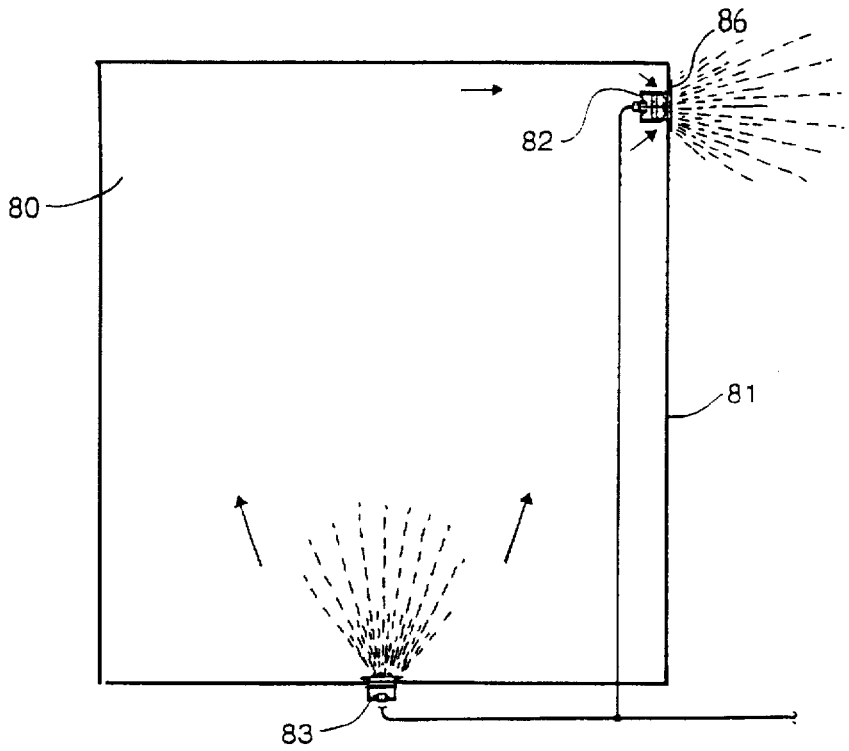
FIGS. 14 and 15 show two embodiments of the invention in which the smoke gases are from a cabin or room.

In FIG. 14, a room is indicated by 80 and an outer wall thereof is indicated by 81. A first spray head 82 is mounted in an opening in the wall 81 and is directed out of the room 80, and a second sprinkler 83 is mounted in the floor or in a wall and is directed into the room. When activated, as shown in FIG. 14, said first spray head 82 sprays water to the outside of the room, preferably out in the open air, and exhausts smoke gases at the same time, whereas the second sprinkler 83 extinguishes the fire.

Figure 15:
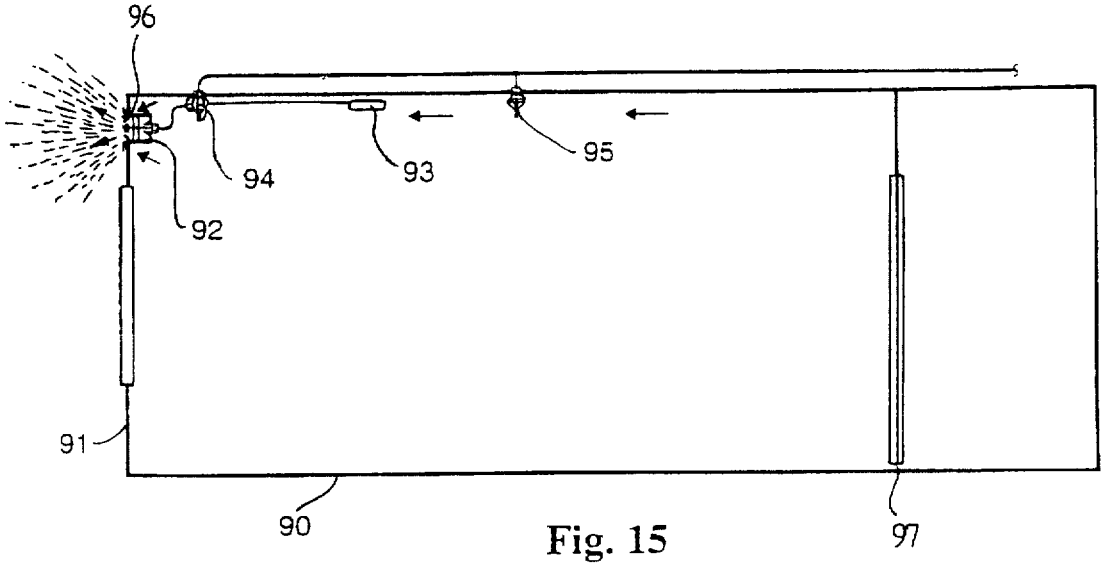

FIG. 15 shows an embodiment alternative to the one of FIG. 14. A room or cabin is indicated by 90, a wall facing to the outside is indicated by 91, a sprinkler or spray head mounted in an opening of the wall 91 is indicated by 92, a smoke detector at the ceiling of the room is indicated by 93, a guide valve operated by the smoke detector 93 is indicated by 94 and a sprinkler at the ceiling is indicated by 95.

In FIG. 15, the detector 93 has reacted and has actuated the valve 94 to activate the wall sprinkler or spray head 92 which sprays water to the open air and thereby exhausts smoke out of the room by suction. The ceiling sprinkler 95 which generally requires a certain raise in temperature before being activated, is not yet in operation. Thus, smoke exhaustion is initiated at an early stage of a fire.

FIG. 16 shows an adaptation of smoke exhaustion. The reference numeral 100 indicates a ceiling or a wall of a room. Openings 101 lead to an air duct 102. A sprinkler or a spray head 103, preferably governed by a smoke detector, is positioned in the duct 102 to produce, when activated as in FIG. 16, a suction from the room through the openings 101 into the duct 102 and further out.

Correspondingly in FIG. 17, a sprinkler 107 produces a suction through an opening 105 from a space below a ceilng 104 into a duct 106 which continues somewhat wider (108) after the sprinkler 107.

In FIGS. 18 and 19, the reference numeral 110 indicates a ceiling or a wall, 111 indicates a spray head mounted in an opening of the ceiling or wall and 112 indicates a sprinkler which upon activation passes liquid through a branch to the spray head 111, e.g. as the one in FIG. 8. As shown in FIG. 19, the spray head may be mounted in a holder 113 with apertures 114 and fastened by means of e.g bolts, as indicated by 115. In activated state, as shown in FIG. 19, a cover has popped off, e.g. as presented in the international patent application PCT/FI92/00213.

In FIGS. 20 and 21, numerals 120 and 130 indicate a ceiling or wall, 121 and 131 indicate spray heads. The spray head 121 is activated by means of a release ampoule or bulb, as a sprinkler, while the spray head 131 is remote controlled.

FIG. 22 shows a cabin or room 140 with a sprinkler 141 mounted on the wall above a door. A channel 142 leads from the ceiling to the open air, with a spray head 143 mounted at the outer end of the channel. The spray head 143 is activated, through a valve 144 preferably governed by a smoke detector not shown, and creates a suction in the channel 142 to exhaust smoke from the room 140.

FIG. 23 shows an alternative embodiment, with a ceiling sprinkler 151 of the same kind as the sprinkler 112 in FIG. 18. When activated, the sprinkler 151 passes liquid through its branch to a spray head 153 which creates a suction in a channel 152 and thus exhausts smoke from a room 150.

In the furher alternative embodiment of FIG. 24, a sprinkler 161 is mounted in a wall opening leading from a room to a corridor 164. A spray head 163 is activated by the sprinkler 161, in principle in the same manner as in FIGS. 18 and 23, and sucks smoke out of the room 160 through a channel 162. Smoke is also sucked in from the corridor 164 past the sprinkler 161.

As has been indicated earlier, it is not always, possible to arrange that spray head or sprinkler which is intended to create a suction out of the respective room in such a way that the liquid is sprayed out into the open air; sometimes the liquid is sprayed into regular ventilation ducts or the like. FIGS. 25 and 26 show two embodiments for preventing liquid from entering the ventilation duct and for recovering a major part of the liquid.

A ventilation duct with an ordinary fan are indicated by 170 and 180, respectively, and 171 and 181, respectively. A spray head 172 and 182, respectively sucks smoke into a channel 173 and 183, respectively. In FIG. 25, the channel 173 has a closed end 175 and at a short distance from the closed end 175 a connection channel 174, preferably essentially perpendicular to the suction channel 173, leads to the ventilation duct 170. The liquid drops stop against the closed channel end 175 and most of the liquid flows down into a draining pipe 176. In FIG. 26, the liquid drops hit a bend 185 before a connection channel 184 to the ventilation duct 180, and most of the liquid flows down into a draining pipe 186.

The basic idea of the present invention, i.e. to employ a sprinkler or a spray head for creating a suction to remove smoke gases from that space, in which a fire has started, can also be utilized in comparatively large spaces, such as restaurants. (A sprinkler generally has a release element, e.g. a glass ampoule reactive to heat or smoke, whereas a spray head need not have a release element of its own; it can be e.g. remote controlled.)

FIG. 25 shows schematically one embodiment for such a case. Sprinklers are indicated by 190, smoke detectors/heat detectors are indicated by 191 and smoke exhaustion ducts are indicated by 192. The sprinklers 190 are preferably, but not necessarily arranged to be released in groups, e.g. as presented the international patent application PCT/FI92/00316. Adjacent groups overlap each other, i.e. a border row of sprinklers belong to two groups.

Smoke exhaustion is preferably arranged to activated in a similar group release manner, that is, when any smoke detector reacts, it activates e.g. the four nearest surrounding smoke exhaustion ducts 192 in any of the ways described earlier.

In many, probably most installations here contemplated, it is preferable to arrange the system to be at least partially automatically released. The invention is not, however, restricted to automatically operating installations; e.g. of installations in engine rooms in ships a possibility for manual operation is generally required.

The invention can also be utilized in a reverse manner, that is, the monitored space can be the open air, for purifying intake air from contaminations, e.g. radioactive contaminations. The embodiments of FIGS. 25 and 26 are useful for that purpose. In particular, all types of shelter rooms and military vehicles or vessels have a potential need for such installations.

I claim:

1. Installation for fighting fire, comprising at least one sprinkler or spray head (6;33;55;62;72) in connection with a monitored space (1;30;50;60;70), said at least one sprinkler or spray head being arranged upon activation to create a suction out of the monitored space by spraying liquid from a high drive pressure into the form of small droplets, like a fog, thereby to suck smoke from said monitored space, wherein said at least one sprinkler or spray head is arranged in an opening (8;58) into said monitored space from an air passage (7;12;19;34;57;63;73) which is in communication with at least one further opening (9;35;59;64;65;74;75) into said monitored space so that said at least one sprinkler or spray head, when activated, produces a suction into said air passage and a circulation of said liquid in the form of small droplets in said monitored space.

2. Installation as claimed in claim 1, wherein said at least one sprinkler or spray head has means for activation by a smoke detector.

3. Installation as claimed in claim 1, wherein said at least one sprinkler or spray head (6;33;55;62) is an automatically releasable sprinkler for spraying extinguishing liquid in said monitored space (1;30;50;60).

4. Installation as claimed in claim 1, wherein a filter (10) is positioned in said air passage.

5. Installation as claimed in claim 1, wherein said at least one further opening (9) is positioned in a ceiling of said monitored space (1) near a door (3) leading out of said monitored space.

6. Installation as claimed in claim 4, wherein said filter is positioned in said at least one further opening.

* * * * *